US009456282B2

(12) United States Patent
Tang

(10) Patent No.: US 9,456,282 B2
(45) Date of Patent: Sep. 27, 2016

(54) BONE-CONDUCTION SPEAKER

(71) Applicant: Larry Tang, East Brunswick, NJ (US)

(72) Inventor: Larry Tang, East Brunswick, NJ (US)

( * ) Notice: Subject to any disclaimer, the term of this patent is extended or adjusted under 35 U.S.C. 154(b) by 0 days.

(21) Appl. No.: 14/735,760

(22) Filed: Jun. 10, 2015

(65) Prior Publication Data

US 2016/0021452 A1 Jan. 21, 2016

Related U.S. Application Data

(60) Provisional application No. 62/024,489, filed on Jul. 15, 2014.

(51) Int. Cl.
*H04R 11/00* (2006.01)
*H04R 9/02* (2006.01)

(52) U.S. Cl.
CPC ..... *H04R 11/00* (2013.01); *H04R 9/025* (2013.01); *H04R 2460/13* (2013.01)

(58) Field of Classification Search
CPC ..... H04R 2460/13; H04R 1/1016
USPC ..... 381/151, 326, 380
See application file for complete search history.

(56) References Cited

U.S. PATENT DOCUMENTS 1,940,553 A * 12/1933 Lieber ..... H04R 11/00 381/151
2,165,710 A * 7/1939 Koch ..... H04R 11/00 381/151
4,006,318 A * 2/1977 Sebesta ..... H04R 1/46 381/151
4,843,628 A * 6/1989 Hofer ..... H04R 1/46 381/151
5,321,763 A * 6/1994 Lee ..... A61H 23/0236 381/151
6,141,427 A * 10/2000 Fukuda ..... H04R 13/00 381/151
7,466,833 B2 * 12/2008 Lee ..... H04M 1/03 381/151

* cited by examiner

*Primary Examiner* — Suhan Ni
(74) *Attorney, Agent, or Firm* — Charles I. Brodsky

(57) ABSTRACT

A bone-conduction speaker unit including a resilient metallic voice screen having a plurality of substantially equally spaced locking elements around a periphery thereof, coupling with a yoke supporting a centered magnet within a magnetic ring, the voice screen and yoke being above a metal cover of a housing to which a bone-conduction speaker so formed is affixed.

9 Claims, 3 Drawing Sheets

BONE-CONDUCTION SPEAKER

STATEMENT REGARDING FEDERALLY SPONSORED RESEARCH OR DEVELOPMENT

Research and development of this invention and Application have not been federally sponsored and no rights are given under any Federal Program.

CROSS-REFERENCE TO RELATED APPLICATIONS

A Provisional Patent Application covering the invention described herein was filed on Jul. 15, 2014, and assigned Ser. No. 62/024,489.

REFERENCE TO A MICROFICHE APPENDIX

Not Applicable.

BACKGROUND OF THE INVENTION

1. Field of the Invention

This invention relates to bone conduction-speakers, in general, and to a bone-conduction speaker-unit particularly employable for earbud speakers.

2. Description of the Related Art

As is known, bone-conduction speakers function on a principle where the speaker typically includes a transducer to receive an electrical signal (such as an audio signal) and to generate a controlled vibration in response. When worn, the transducer transmits the vibration to the bones of the wearer's skull—from which, it is transmitted to the wearer's inner ear. The bone conduction then enables sound to be transmitted this way to the wearer's inner ear by vibration, rather than by way of sound waves that travel through the air to enter the wearer's outer ear.

Bone-conduction speaker designs, however, typically suffer from somewhat less than optimal sound richness quality, particularly at the low and mid frequency ranges; they also tend to exhibit noticeable amounts of decreased durability in use. Experience has shown these undesirable features become more pronounced, furthermore, as the wearer ambulates in tending to move about, instead of his/her just sitting in place. Testings have shown that this is at least partially because of the manners by which the innards of the bone-conduction speaker have been stabilized—most often with bonding adhesive techniques.

OBJECTS OF THE PRESENT INVENTION

It is an object of the present invention, therefore, to provide a bone-conduction speaker which provides a more robust sound and, at the same time, establishes an increased securement of its component parts to its vibration actuator during wearer movements about.

SUMMARY OF THE INVENTION

As will become clear from the following description, the bone-conduction speaker of the invention essentially employs internal and external magnets along with a novel voice screen actuator to resonate in creating the controlled vibrations for the inner ear bones. As will also become clear, this voice screen is of a resilient metallic composition that includes a plurality of substantially equally spaced locking elements around a periphery thereof, coupling with a yoke to support the internal magnets of the speaker within an external magnetic ring. As will be described, two separate embodiments of the invention satisfy the above objectives—each utilizing a precious metal voice screen fabrication of titanium or tungsten, or similar such non-brittle, resilient materials.

BRIEF DESCRIPTION OF THE DRAWINGS

These and other features of the invention will be more clearly understood from a consideration of the following description, taken in connection with the accompanying Drawings in which.

DETAILED DESCRIPTION OF THE INVENTION

Figure 3:
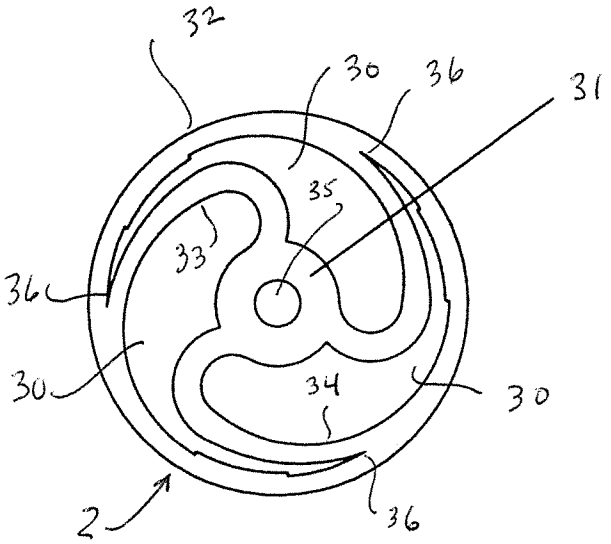
FIG. 3 is a plan view of the voice screen used in the bone-conduction speaker units of the FIG. 1 and FIG. 2 embodiments.

Referring to FIG. 3, the resilient, non-brittle metallic voice screen 2 of the bone-conduction speaker unit has three leaf spring prong portions 30, each extending along a spiral curve between central and peripheral portions 31, 32. Each of the leaf spring prong portions 30 is formed by inner and outer curves 33, 34 substantially parallel to the curve of the periphery shown in circumferential layout. An elongated hole 35 is centrally located with respect to the periphery 32 of the voice screen 2, with each of the leaf spring prong portions 30 terminating in substantially a point 36. As will be understood, the voice screen 2 essentially constitutes a single piece of preferably titanium or tungsten material of a circular-arcuate spiral, whose individual "prongs" would be vibrating in generating the resultant "sounds". (Other types of precious metal materials similarly may instead be used for the screen.)

Figure 1:
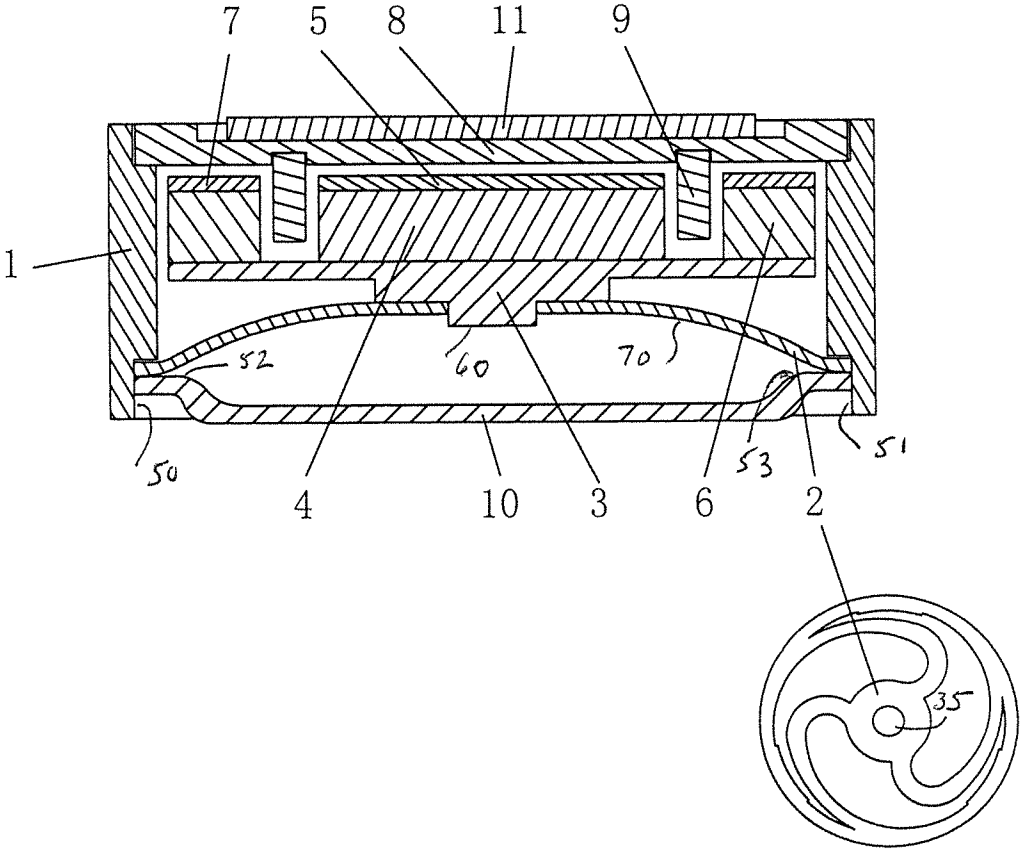
FIG. 1 is a longitudinal sectional view illustrating the manner by which a first embodiment of the bone-conduction speaker unit of the invention is incorporated within a housing.

The bone-conduction speaker unit of the FIG. 1 embodiment comprises a housing 1 defined by a metal cover 10 and a printed circuit board 11 which mechanically supports, and electrically converts, the electronic components using conductive track pads and other features etched from copper sheets laminated into a non-conductive substrate in conventional manner. A yoke 3 having a centered magnet 4 within a steel plate 5 is disposed between an external magnetic ring 6 encircling a voice coil 9. Such voice coil 9, in turn, is disposed between a steel ring 7 and an upper cover 8. In typical usage for an in-ear headphone, the speaker housing 1 couples with a first earbud housing, while the printed circuit board 11 couples with a second earbud housing at one end, for example, of an electrical cord connecting headset. With the magnet 4 and the external magnetic ring 6, with the voice screen 2 as described, and with the elongated hole 35 of the voice screen 2 in alignment to receive a lower extending section 60 of the yoke 3, enriched sounds at the low and mid frequency ranges are produced as compared to the more conventional constructions employing a spring vibration in producing an auditory input to the inner ear.

Figure 2:
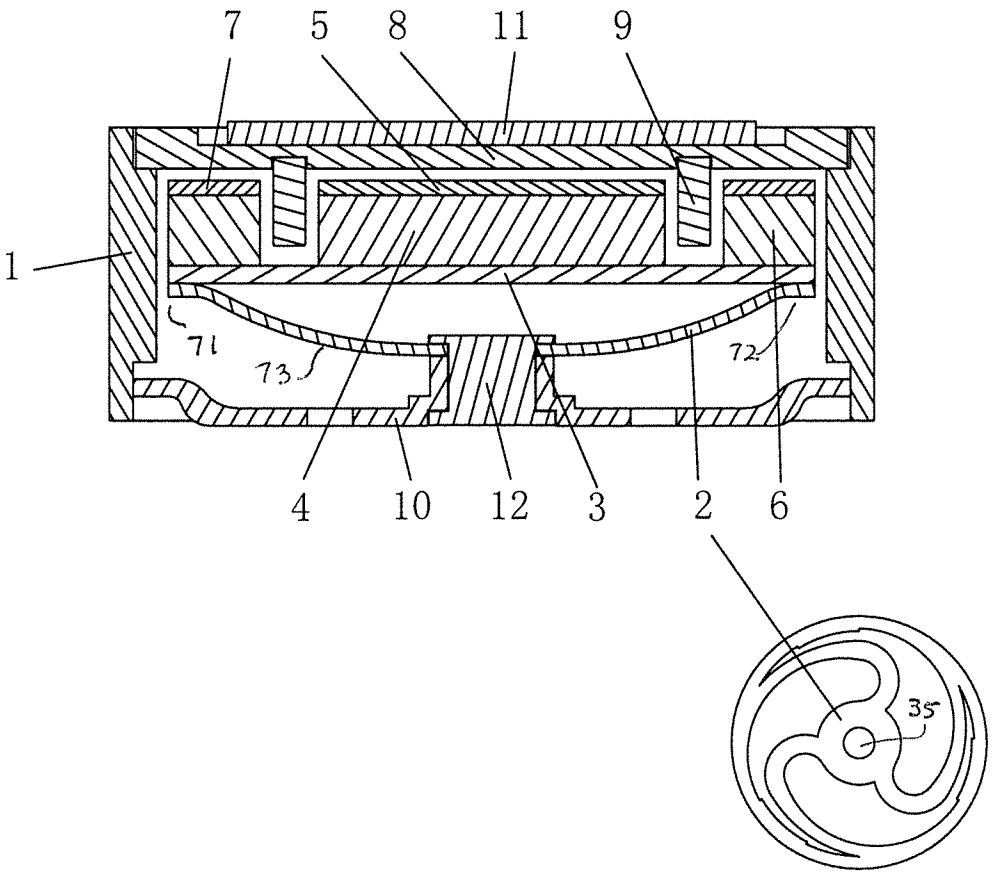
FIG. 2 is a longitudinal sectional view of a second embodiment of a bone-conduction speaker unit according to the invention, similarly built into the housing.

While the embodiments of FIGS. 1 and 2 each produce enhanced sound reproduction, their constructions differ insofar as the securement of the operative inner parts of the bone-conduction speaker unit are concerned. In each of the embodiments of FIGS. 1 and 2, inside side wall surfaces of the housing 1 are notched at 50, 51 in receiving curved edges 52, 53 of the metal cover 10. In the embodiment of FIG. 1 on the one hand, the yoke 3 is fabricated of a 3 level "step" construction, with the smallest section 60 configured to press fit within the elongated hole 35 of the voice screen 2. Equally spaced, opposing edge sections of the periphery 32 of the voice screen 2 are likewise fitted to be held by the notches 50, 51 of the housing walls in securing with the upwardly curved edges 52, 53 of the cover 10, yielding a downwardly curved voice screen lock as shown at 70.

In the FIG. 2 embodiment of the invention, on the other hand, the yoke 3 is configured as a substantially flat plate, and a rivet 12 extends upward through the metal cover 10 to secure with the elongated hole 35 of the voice screen 2—whose equally spaced, opposing sections of the periphery are then secured in place as at 71, 72 under the yoke 3 in giving an upwardly curved look to the thereby locked voice screen, as at 73.

Both arrangements of FIGS. 1 and 2 thereby mechanically capture and secure with the voice screen 2 not only physically, but as ensuring that only the inputted electrical signal causes the screen 2 and its spring prong portions 30 to vibrate; and not any motion of the bone-conduction speaker unit components as a result of a wearer's moving about while wearing the bone-conduction speaker. As the mechanical pressure applied in holding the voice screen in position changes the securement without any adhesive bonding, the common tendency for the adhesion to lessen over time will be understood to be substantially obviated. In effect, the constructions of the FIGS. 1 and 2 embodiments produce equally spaced locking elements around the periphery of the voice screen in fixing the bone-conduction speaker so formed by its associated components.

While there have been described what are considered to be preferred embodiments of the present invention, it will be readily appreciated by those skilled in the art that modifications may be made without departing from the scope of the teachings herein. Different compositions of materials can be used in constructing the resilient, metallic non-brittle construction of the voice screen besides titanium and tungsten, consistent with the advantages provided by the utilization of precious metals in their fabrications. And, likewise, different configurations for the voice screen may be employed as well as the circular configuration of FIG. 3 in providing an increased richness of sound and increased stability of operation. For at least such reasons, therefore, resort should be had to the claims appended hereto for a true understanding of the scope of the invention.

I claim:

1. In a bone-conduction speaker, the combination comprising:

a housing having a set of upper notch extremities and a set of lower notch extremities within inside side walls of the housing, and also having upper and lower covers;

first and second pairs of notched extremities in said upper cover, extending between said set of upper notch extremities of said inside side walls of said housing;

a printed circuit board extending between said first pair of notched extremities of said upper cover;

a steel ring underlying said upper cover of said housing;

a voice coil disposed between said steel ring and said upper cover of said housing;

a magnetic ring encircling said voice coil;

a steel plate within said magnetic ring;

a yoke having a centered magnet within steel plate;

a resilient voice screen of three leaf spring prong portions, each extending along a spiral curve between central and peripheral portions thereof, with each being formed by inner and outer curves substantially parallel to a curve of said peripheral portions, with each of said leaf spring prong portions terminating in substantially a point;

a lower cover underlying said voice screen having opposing ends fitted into said pair of lower notch extremities of said inside side walls of said housing to be mechanically captured therein; and with said points of each leaf string portion bearing against one of an underside of said yoke and a top side of said lower cover fitted into said pair of lower notch extremities.

2. The combination of claim 1 wherein said voice screen includes an elongated hole centrally located with respect to said periphery portions of said voice screen to receive said centered magnet of said yoke.

3. The combination of claim 2 wherein said points of each leaf spring portion is fitted within said pair of lower notch extremities.

4. The combination of claim 2 wherein said voice screen includes an elongated hole centrally located with respect to said periphery portions of said voice screen, and also including a rivet upwardly extending through said lower cover to secure with said elongated hole.

5. The combination of claim 4 wherein said points of each leaf spring portion bear against an underside of said yoke.

6. The combination of claim 3 wherein said voice screen is of a resilient, non-brittle precious metal.

7. The combination of claim 5 wherein said voice screen is of a resilient, non-brittle precious metal.

8. The combination of claim 3 wherein said voice screen is of a resistant, non-brittle tungsten or titanium precious metal.

9. The combination of claim 5 wherein said voice screen is of a resistant, non-brittle tungsten or titanium precious metal.

* * * * *